United States Patent [19]

Sial

[11] Patent Number: 4,892,560

[45] Date of Patent: Jan. 9, 1990

[54] FUELS

[76] Inventor: Nasir M. Sial, c/o Fanar Overseas Limited, Malcolm House, 12 Orange Street, London, England

[21] Appl. No.: 13,829

[22] PCT Filed: Jun. 10, 1985

[86] PCT No.: PCT/GB85/00254

§ 371 Date: Feb. 10, 1987

§ 102(e) Date: Feb. 10, 1987

[87] PCT Pub. No.: WO86/07375

PCT Pub. Date: Dec. 18, 1986

[51] Int. Cl.[4] ..... C10L 1/00; C10L 1/32

[52] U.S. Cl. ..... 44/50; 44/51; 44/77

[58] Field of Search ..... 44/50, 51, 77

[56] References Cited

U.S. PATENT DOCUMENTS

| | | | |
|---|---|---|---|
| 776,365 | 11/1904 | Spelman | 44/51 |
| 1,835,998 | 12/1931 | Giron | 44/51 |
| 2,603,557 | 7/1952 | Roush | 44/51 |
| 3,902,869 | 9/1975 | Friberg et al. | 44/51 |
| 4,425,136 | 1/1984 | Pearson et al. | 44/51 |

FOREIGN PATENT DOCUMENTS

| | | |
|---|---|---|
| 57-055995 | 4/1982 | Japan . |
| 57-164189 | 10/1982 | Japan . |
| 58-198590 | 11/1983 | Japan . |

*Primary Examiner*—William R. Dixon, Jr.
*Assistant Examiner*—Margaret B. Medley
*Attorney, Agent, or Firm*—Pennie & Edmonds

[57] ABSTRACT

Molasses is a by-product in the manufacture of cane-sugar. Attempts to use molasses as a fuel, for example in boilers, have been unsuccessful. The present invention provides a mixture of molasses and fuel oil, particularly a homogenized mixture which can be used as a viable alternative to fuel to displace fuel oil in industrial combustion equipment, and also provides a method of improving the burning qualities of molasses. The molasses-fuel oil mixture is more efficient as a fuel than just molasses alone and will be of especial use in areas where molasses is costly to transport and is easily available, and costs associated with fuel oils are high.

17 Claims, 7 Drawing Sheets

(1)

(1)

FUELS

A fuel is a substance used for producing heat energy, commonly by combustion. Combustion fuels in commercial use to be successful should have a high calorific value, should be stable when not required for use, and should provide heat efficiently and economically and in a controlled manner. Such fuels are used in both the domestic and the industrial sphere and in common use are petroleum products, natural gas, coal, wood, and peat. In large scale commercial operations combustion equipment has been developed to harness the heat energy produced from petroleum products, natural gas, and coal, of which the most common industrial combustion fuel used are the petroleum based products, for example the petroleum-based fuel oils which are burned in industrial furnaces to generate heat.

Petroleum-based fuel oils are, however, becoming increasingly expensive and many attempts have therefore been made to find alternative fuels.

A further disadvantage of petroleum-based fuel oils is that they occur only in certain parts of the world and usually have to be transported in large quantities to the desired location for their use. An additional disadvantage is that the available resources are limited and are depleting.

Molasses, sometimes termed final molasses or blackstrap, is a by-product in the manufacture of cane sugar and beet sugar, from which generally no more sugar can be obtained economically by crystallisation. It is a heavy sticky, viscous, aqueous syrup comprising, in the case of cane molasses, for example, from 25 to 40% sucrose; from 10 to 25%, for example from 15 to 20%, reducing sugars; from 7 to 15%, for example about 10%, ash; from 2 to 10% organic non-sugars; and from 5 to 25%, for example about 20%, water. Although there are uses for molasses, for example it is incorporated in animals feeds and it is used in the manufacture of various alcohols, acetone and citric acid and in yeast propogation, it is primarily a by-product.

Molasses has poor combustion characteristics with a low calorific value and a high water content, and has never seriously been considered as a commercial fuel. In the main review literature for the sugar industry (Cane Sugar Handbook by Meade and Chen last published in 1977, and Beet Sugar Technology by McGinnis published in 1971) no mention is made of such use. Early attempts were made to use molasses as a fuel in, for example, commercial boilers but were not very successful, there being too many disadvantages associated with its use. The last such attempt recorded in the literature was in 1938 (International Sugar Journal, Vol. 40, pages 141 to 145, 1938).

Such attempts have not been successful for a number of reasons. The low calorific value of the molasses and high water content prevented the temperature in the combustion chamber from rising high enough to sustain stable combustion. Efforts were made to rectify this by improving the insulation and changing the design of the fire-box and by developing special ovens and burners, but it was found to be costly for such adaptation of existing equipment and these proposals were not taken up commercially.

There are several drawbacks in using molasses as a commercial fuel on its own. First of all it does not burn properly and it also needs to be diluted with water to run through the conventional burner equipment; this adds to the already high water content and causes loss of available heat, it being required for evaporation of water in the fuel. It was these drawbacks that caused early experimenters to alter the equipment design in an attempt to use molasses. Molasses also gives rise to large quantities of ash which would cause handling problems and require frequent stoppage of a plant for cleaning purposes. Further, as mentioned above molasses on its own has very poor combustion characteristics and difficulties would arise with flame stability and sustained combustion at a temperature required commercially.

Molasses is available in large quantities, some thirty three million tons are produced annually, but its use is limited mainly to specialised recovery of sugar (from beet molasses), conversion to ethyl alcohol used inter alia as an automobile fuel, as a fermentation substrate for many products including rum, and as a cattle feed additive. It is produced mostly in Africa, South America, the Caribbean, and in Asia, in countries which have to import petroleum-fuel oils in large quantities and at high cost. The molasses often itself has to be transported again at high cost to the U.S.A. or to Europe for further processing into the more useful products.

For those countries having access to large quantities of molasses, it would be of great advantage to be able to use the product commercially and economically as a fuel, displacing at least partially the dependence on the expensive, imported petroleum-fuel oils presently used.

The present invention therefore concerns a simple and unique method of rendering molasses an efficient and useful commercial fuel and is based on the observation that the combustion qualities of molasses can be improved and upgraded to give an improved fuel, so that it becomes possible to utilise molasses effectively as a fuel, especially in industrial combustion equipment, by mixing with a fuel oil.

The present invention therefore provides a mixture of molasses and a fuel oil.

The present invention also provides a method of generating heat, which comprises burning a mixture of molasses and a fuel oil.

According to the present invention, molasses and a fuel oil are mixed together to form a combustible mixture. Ordinarily, the aqueous syrupy material molasses will not readily mix with an oily material such as a petroleum-based fuel oil, but it has now been found possible to form a stable mixture by very intensive mixing.

Preferably the mixture of the present invention is a homogenised mixture. Advantageously, the molasses and fuel oil are mixed together in a high-power homogeniser, causing very intimate mixing of the two components to give a homogeneous product that is very stable even after prolonged standing, that can be handled easily and that is more readily combustible and has better burning characteristics than the molasses alone. It was surprising to find that molasses and a fuel oil could be homogenised. The homogenisation of fuel oil and molasses has not previously been proposed or put forward.

Any high-power homogeniser capable of intimately mixing the two components may be used, but particularly suitable homogenisers are those that have been developed by the marine industry, for example, a Vickers Fuel Oil Homogeniser. It is possible that ultrasonic mixers may also prove useful in mixing the two components.

The fuel oil used according to the invention is preferably a petroleum-based fuel oil, and may be a distillate fuel oil, for example, kerosine, diesel oil, or gas oil, or a residual fuel oil, for example bunker C oils and other residual fuel oils for example, light, medium and heavy residual fuel oils.

The molasses:fuel oil ratio in the mixture according to the invention may be any desired ratio, and is advantageously within the range of from 5:95 to 95:5 by weight, and preferably within the range of from 25:75 to 75:25 by weight. Preferred ratios optimise the advantages of using as high a proportion of molasses as possible and any disadvantages of reducing the proportion of fuel oil, for example possible reduction in the combustion performance of the mixture. The preferred ratio for any particular instance will depend on a large number of factors including the intended use and desired combustion temperature and performance of the mixture, and the relative availabilities and characteristics of fuel oil and of molasses.

In general, a preferred molasses:fuel oil ratio is within the range of from 25:75 to 60:40 by weight for example 40:60 by weight. Preferably up to 50% by weight molasses is present, and particularly preferred is a molasses:fuel oil ratio of 50:50 by weight.

In some cases it may be advantageous to incorporate a small quantity of a homogenising agent, for example an emulsifier, into the mixture according to the invention. This can have the advantage of facilitating homogenisation of the mixture and it may also have an advantageous effect on the combustion properties of the mixture.

The mixture according to the invention can be used as a fuel for a wide variety of purposes, for example for burning in steam generating boilers, in gas-turbines or in various types of kilns and incinerators, for example, lime kilns and kilns for brick making and making of cement and ceramics, including rotary kilns, and possibly in internal combustion engines.

It will be appreciated that the optimum molasses:fuel oil ratio may differ according to the apparatus in which it is to be burnt, and may be determined empirically.

The present invention provides a method whereby molasses is up-graded in such a manner as to make use of its combustibility while reducing the handling difficulties and improving its combustion properties to enable it to be used as a fuel for boilers, for example. Thus, the present invention provides a means of increasing the economic value of molasses, which would otherwise be, in certain circumstances, a waste product.

The present invention may of course be used in many situations but it finds particular value in situations where molasses is in plentiful supply and where fuel oils are not readily available.

The following Examples illustrate the invention. In the Examples 'BS' denotes 'British Standards'.

The attached drawing figures show the results of these Examples, wherein.

EXAMPLE 1

Homogenisation of molasses/fuel oil mixtures

Figure 1:
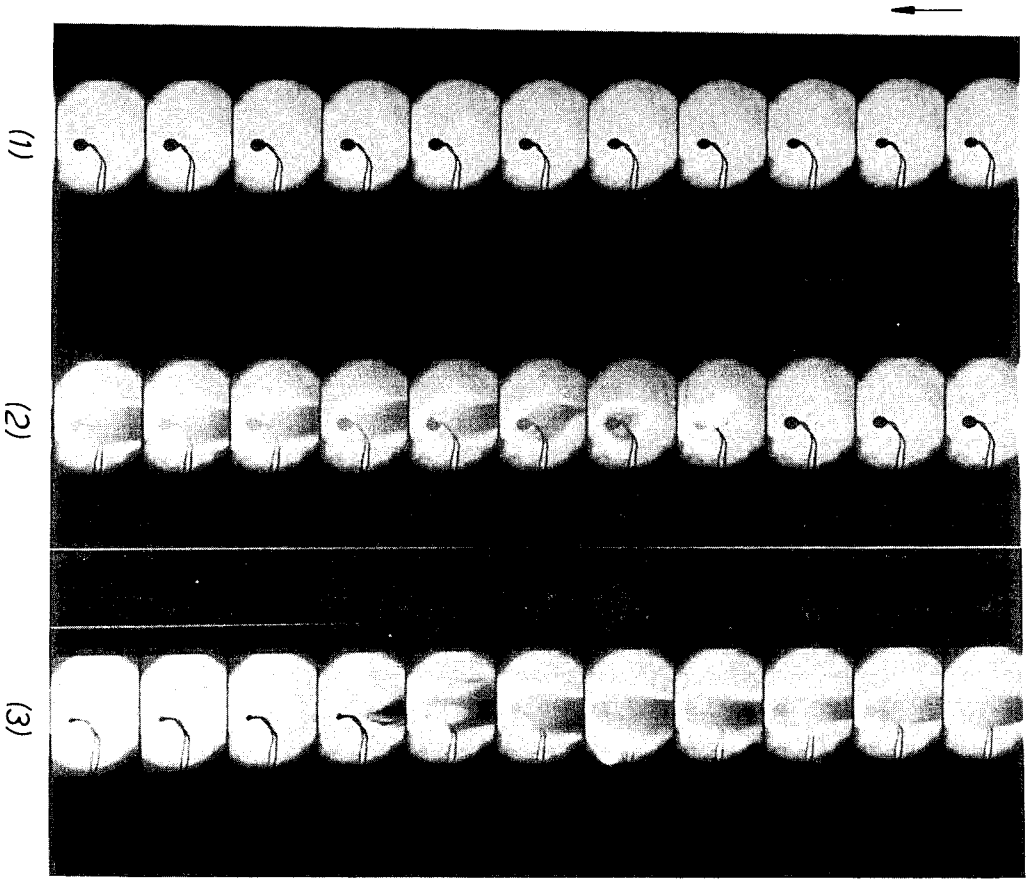
FIG. 1 illustrates the burning behavior of a single droplet of 100% fuel oil.

Molasses: Final sugar cane molasses (sometimes termed blackstrap sugar cane molasses) available commercially from United Molasses.

Fuel Oils:

(A) a heavy residual fuel oil of the type graded No. 6 (BS 2869 class G)

(AII) a light to medium residual fuel oil of the type graded No. 5 (BS 2869 class F)

Homogeniser: Vickers Fuel Oil Homogeniser (manufactured by Vickers Shipbuilding & Engineering Ltd.).

Appropriate amounts of the molasses and the fuel oil were placed in a container adjacent to the homogeniser inlet. With the homogeniser running, the two liquids were allowed to flow into the bowl of the homogeniser, while the resultant mixture was collected in a second container at the homogeniser outlet. A visual assessment of the mixture was made after it left the homogeniser.

Samples were analysed for specific gravity, viscosity, and, in certain cases, for calorific value, and samples were also placed in glass containers for visual inspection at various periods.

| Ratio fuel oil: molasses | Specific Gravity | Calorific Value (BTU's/lb) | Viscosity Redwood No. 1 at 80° C. (seconds) |
|---|---|---|---|
| (A) Heavy residual fuel Oil of type No. 6 | | | |
| 0:100 | 1.409 | 4,755 | 234 |
| 25:75 | 1.334 | 7,825 | 4,548 |
| 50:50 | 1.295 | 9,250 | 12,700 |
| 100:0 | 0.984 | 18,180 | 303.8 |
| 0:100 | 1.409 | 4,755 | 234 |
| 15:85 | 1.348 | 6,480 | 1,014 |
| 20:80 | 1.369 | 7,780 | 1,450 |
| 50:50 | 1.378 | 10,990 | 7,673 |
| 100:0 | 0.982 | 18,270 | 348.4 |
| (AII) Light to medium residual fuel oil of type No. 5 | | | |
| 0:100 | 1.409 | 4,755 | 234 |
| 15:85 | 1.344 | 6,470 | 792 |
| 20:80 | 1.326 | 7,390 | 715 |
| 50:50 | 1.234 | 11,025 | 4,825 |
| 100:0 | 0.937 | 18,460 | 62.5 |

Where, the initial mixture was uneven in consistency, a second pass through the homogeniser resulted in a good mixture. In most cases, a good mixture was achieved at the first pass, with a second passage through the homogeniser resulting in no visual difference in the product.

The samples stored at room temperature showed no visual signs of separation after a month.

Although the viscosity of the product was greater than that of the two components, this is not considered to be a major problem in combustion systems using the molasses/fuel oil mixture, as it can be overcome by extending the aqueous phase by the addition of water, or can be overcome by other means available for dealing with viscous fuels, for example, the provision of heating before atomisation.

EXAMPLE 2

Combustion Tests

The molasses, fuel oil designated (AII) and (AII)-molasses mixtures were tested for combustion properties by the single droplet combustion test as described below.

For the test, an electrically heated tubular furnace constructed from a 20 cm long and 5 cm inside diameter silica tube with two silica side arms sealed into the main tube was used. The temperature of the furnace was controlled using a Chromel-Alumel thermocouple, and a 16 mm Bolix cine camera running at 25 and 50 frames per second was used to film the droplet during combustion. The centre temperature of the droplet during combustion was recorded using a microprocessor at 20 ms time intervals.

The test droplet was suspended at the tip of quartz fibre (0.12 mm diameter) or Pt-Pt 13% Rh thermocouple of 0.1 mm diameter and was exposed to the furnace environment when a water-cooled shield was withdrawn. The droplet combustion was studied at furnace temperatures of 600° C., 700° C., and 850° C.

The experimental apparatus used was the same as that described in literature (see reference 1).

The testing of the combustion of single droplets of various combinations of mixtures of AII and molasses as noted in Table 1, was undertaken by examining their combustion by photographic and thermometric means. Considerable information was obtained on the combustion behaviour of these fuels. In addition, rates of combustion of these sample fuels were calculated which can be applied with some care to combustion chamber calculations.

A. Combustion mechanism.

All of the extracted combustion data for the test fuel mixtures is presented in table 2. In this series of experiments the film sequences for each droplet burned were examined, and qualitative trends were noted, measurements were made of the initial droplet diameter, ($d_0$), the droplet diameter at the moment of ignition, ($d_i$), and the diameter of the residue present at the moment of diffusion flame extinction, ($d_b$). The ignition delay times were correlated for different droplet sizes based on the reduced time, $T_i$, for each droplet defined as $T_i = t_i/d_o$ ($S.mm^{-1}$). $Q_i$ represents instantaneous droplet volative temperature at moment of ignition. In addition, from the droplet size data, the following "$d^2$-law" type rate constants, having dimensions of $mm^2\ s^{-1}$ were evaluated; (see reference 1).

$$K_1 = (d_o^2)/t_b$$
$$K_2 = (d_o^2 - d_b^2)/t_b$$
$$K_3 = (d_o^2 - d_{th}^2)/t_o$$
$$K_4 = (d_o^2 - d_{th}^2)/t_c$$

$d_{th}$ is diameter of the thermocouple bead and $t_o$ and $t_c$ is the overall and residue combustion time respectively.

1 BRAIDE, K. M.; ISLES, G. L.; JORDAN, J. B. and WILLIAMS, A. 'The combustion of single droplets of some fuel oils and alternative liquid fuel combinations'. (Journal of the Institute of Energy, September 1979, pp. 115 et seq.), the contents of which are incorporated herein by reference.

Figure 2:
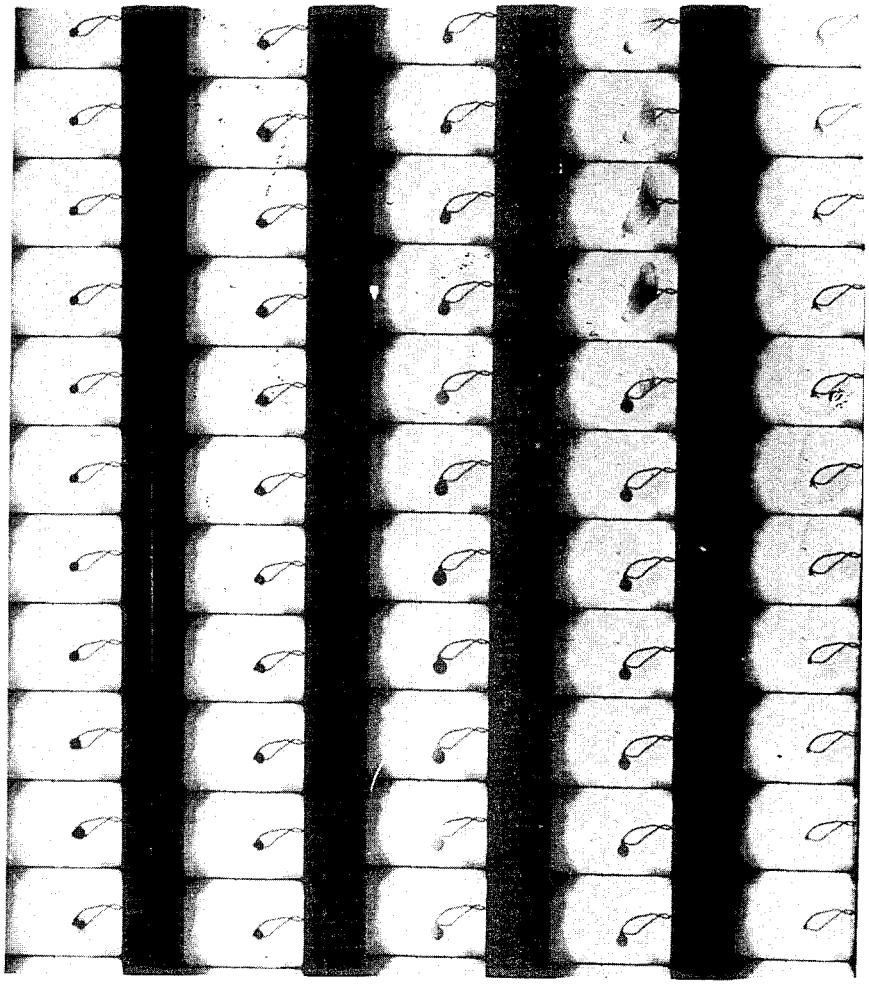
FIG. 2 illustrates the burning behavior of a single droplet of 50% molasses, 50% fuel oil.
Figure 3:
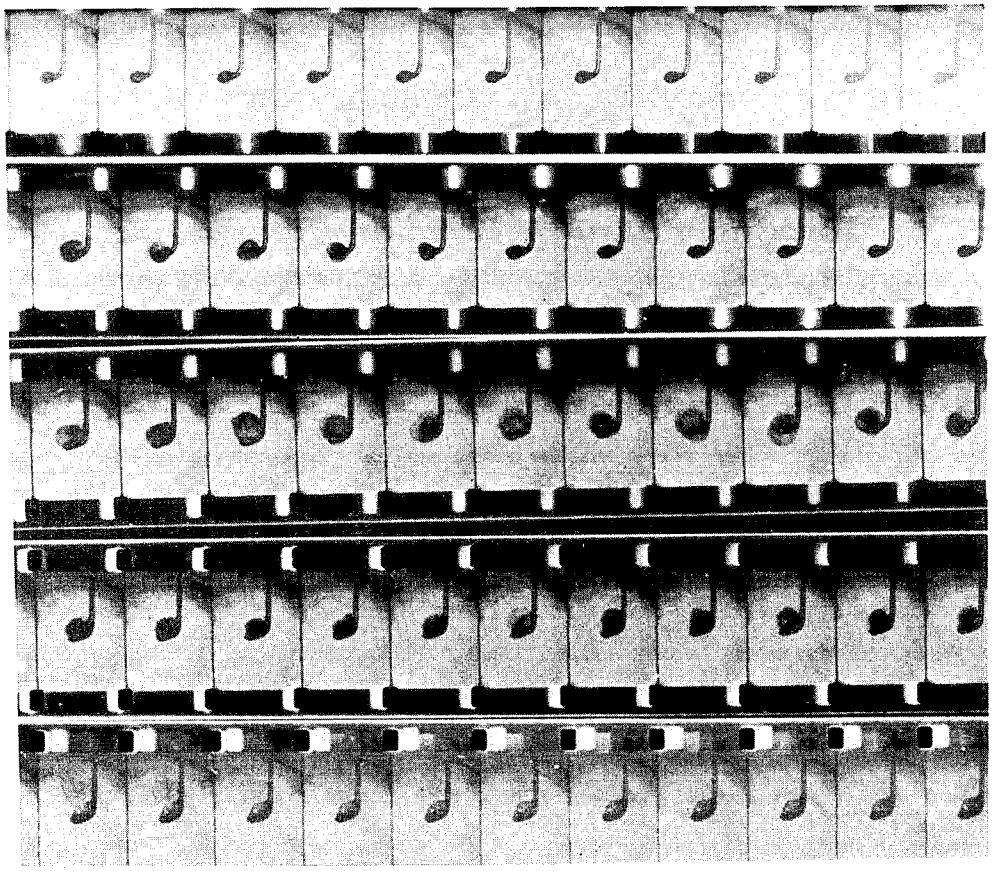
FIG. 3 illustrates the burning behavior of a single droplet of 100% molasses.
Figure 4:
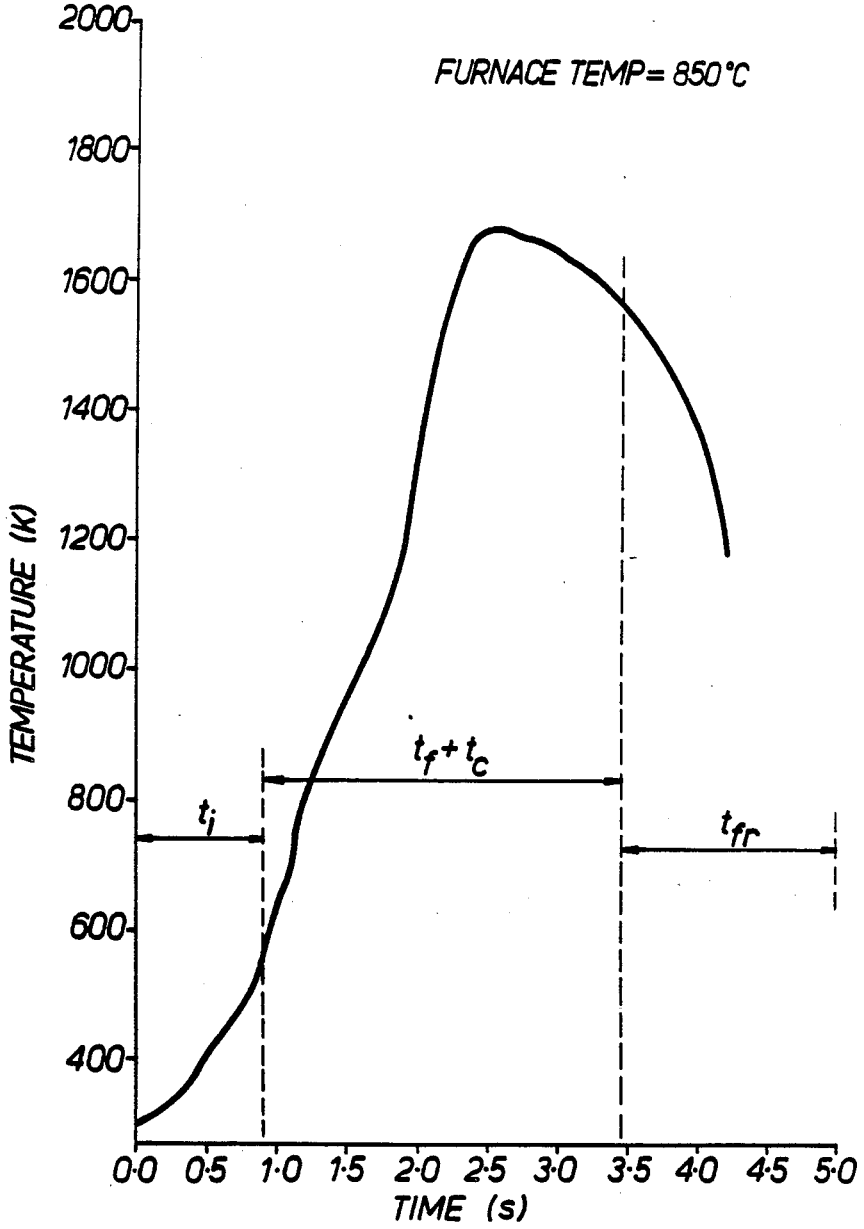
FIG. 4 illustrates the temperature-time history for the burning of 100% fuel oil.
Figure 5:
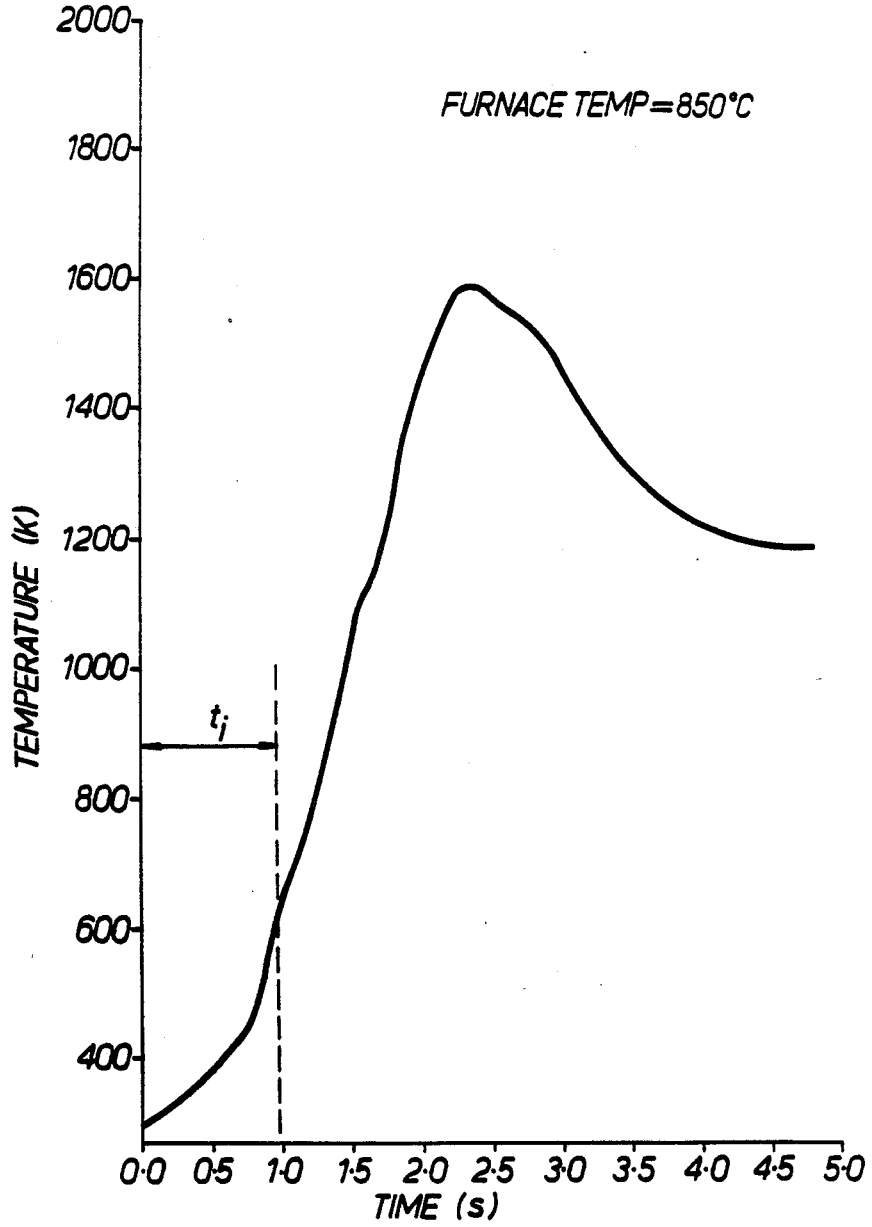
FIG. 5 illustrates the temperature-time history for burning of 50% molasses, 50% fuel oil.
Figure 6:
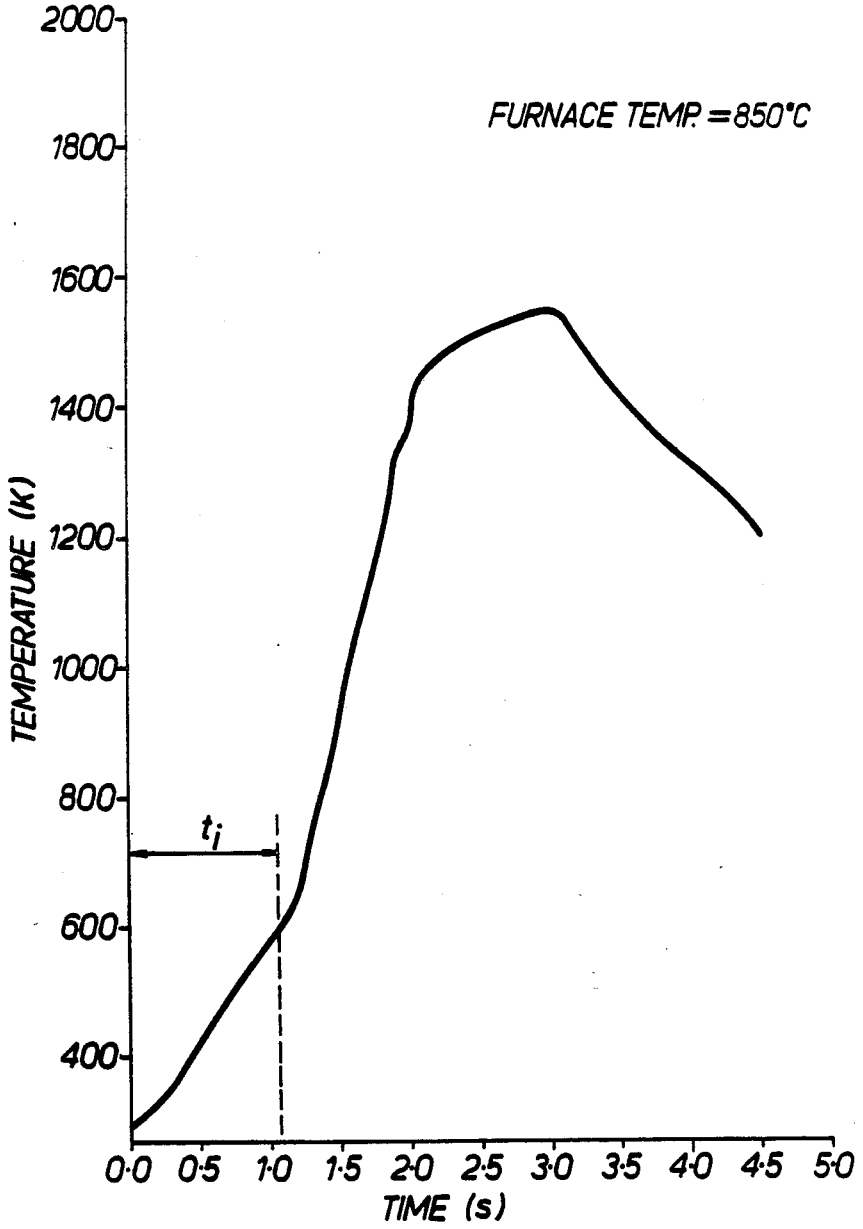
FIG. 6 illustrates the temperature-time history for burning of 80% molasses, 20% fuel oil.
Figure 7:
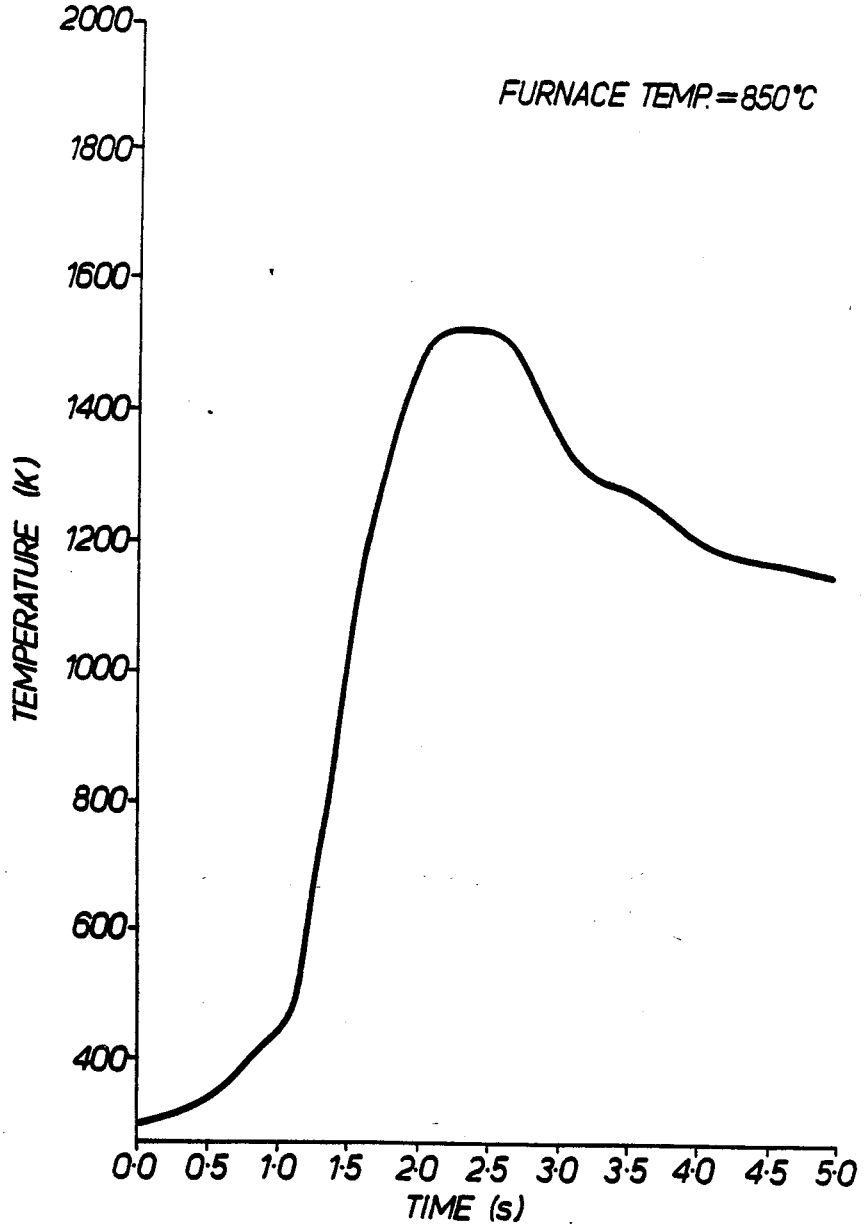
FIG. 7 illustrates the temperature-time history for burning of 100% molasses.

Experimental results indicated that for molasses (sample No. 5) very disruptive droplet combustion prevails over pre-ignition stage and flame life period. During combustion time of the molasses a short blue flame appears around the droplet followed by a significant disruptive size variation prior to and after the ignition of the fuel droplet. The size variations were sporadic in mode. During residue combustion blow holes appear on the bottom of the droplet, progressing upwards, indicating fragmentation stages. The combustion of molasses is shown in FIG. 3. However, addition of fuel (AII) to the molasses changes the combustion mechanism of the fuel droplet. The combustion stages for samples Nos. 2, 3 and 4 can be divided into four distinct periods; (i) Induction period; (ii) short disruptive flame period; (iii) secondary ignition followed by diffusion flame and finally (iv) residue combustion stages (see FIG. 2). The following was observed:

Induction period; Two different induction periods were observed for samples nos. 2, 3 and 4. The molasses component ignites at the early stages of combustion followed by secondary ignition of the fuel oil, and formation of diffusion flame. Primary induction period is independent of the mixture ratio; however, as the % of the molasses increases, the secondary induction period increases as well.

Flame period; Diffusion flame period ($t_b/d_o$) falls on the addition of the molasses, the values being 1.12 for sample No. 1 and 0.56 for sample No. 4. The diffusion flame period for molasses is not significant and in some cases the diffusion flame period was not observed.

Residue combustion; From the analysis of the data presented in Table 2 it can be seen that the fuel oil (sample No. 1) produces a small residue, compared to the other samples. As the presence of the molasses increases in the mixture the size of the residue increases. During combustion of samples Nos. 1 to 4 a small quantity of mineral matter was deposited on the fibre. The quantity of this residue depends on the % of the fuel oil in the test samples. Formation of soot was not observed during combustion of the molasses, but as the % of the fuel oil increases the formation of soot becomes significant.

B. History of droplet temperature.

FIGS. 4 to 7 show typical temperature histories of the droplets of 4 different samples at the same experimental condition (i.e. furnace temperature of 850° C. and droplet size of 1.05±0.1 mm). It can be seen that as soon as the droplet is exposed into the hot atmosphere the temperature of the droplet starts to rise due to gasification, followed by ignition and diffusion flame extinction and residue combustion. All these stages are clearly represented in diagrams FIGS. 4 to 7. There is a significant difference between samples Nos. 1, 2 and 5 with test samples Nos. 3 and 4 in the number of stages during the combustion process.

Experimental results indicated that as % of sample No. 5 increases the maximum centre temperature attained by the droplet reduces. The ignition temperature of the molasses is lower than that of the fuel oil (i.e. 146° C. compared to 331° C. at furnace temperature of 850° C.). The centre temperature of the droplet during diffusion flame period is dependent on the fuel type.

C. Burning rate data.

The overall combustion time rate constant, $K_3$, data shown in Table 2 indicates that the fuel oil burns faster than other test fuel droplets. The value of $K_3$ for the fuel oil is 1.3 to 1.5 times higher than that of samples 3, 4 and 5. The burning rate constant $K_1$ is represented in two sections, one representing combustion during primary ignition at which the burning rate values reduce as the blending ratio of molasses increases. However, the overall burning rate values ($K_1$) based on the primary and secondary ignition and flame period indicates that addition of the fuel oil increases the burning rate of the samples.

The following conclusions were reached:

A. Single droplets of the molasses were burned at temperatures of about 800° C. Whilst it will act as a fuel combustion, it is poor and disruptive. This indicates that the molasses could be burned alone but with great difficulty. Studies of combustion of mixtures with fuel oil give the following conclusions:

(i) Overall induction period decreases as % of the fuel oil increases. However, primary induction period is little affected by the nature of blending ratio.

(ii) The maximum temperature of the droplet increases as the % of the fuel oil increases.

(iii) Disruptive combustion is directly related to the % of molasses. As % of molasses in mixture decreases the disruptive combustion improves. However, microexplosion is observed for mixtures containing >50% fuel oil.

(iv) Fuel droplets of molasses do not follow the general three stage combustion processes.

(v) The total combustion time increases for mixture as the % of the molasses increases.

(vi) The overall burning rate constant for molasses improves as the % of the fuel oil increases.

(vii) Pre-ignition swelling of the droplet is affected by the % of fuel oil AII present.

(viii) In general the combustion mechanism of molasses is improved by the presence of the fuel AII and this is a significant improvement in the combustion behaviour of the fuel droplet.

B. The results indicate that molasses-fuel oil mixtures form satisfactory fuels. It is thought that variation of the fuel oil type will not alter this conclusion.

TABLE 1

| Sample | Fuel A II % | molasses % |
|---|---|---|
| No. 1 | 100% | 0 |
| No. 2 | 50 | 50 |
| No. 3 | 20 | 80 |
| No. 4 | 15 | 85 |
| No. 5 | 0 | 100 |

TABLE 2

| | sample No. 1 | sample No. 2 | sample No. 3 | sample No. 4 | sample No. 5 |
|---|---|---|---|---|---|
| $d_i/d_o$* | — | 1.122 | 1.177 | 1.122 | 1.136 |
| | 1.156 | 1.005 | 0.99 | 0.99 | — |
| $d_b/d_o$ | 0.51 | 0.97 | 1.201 | 1.186 | 1.416 |
| $T_i = \frac{t_i}{d_o}$ * | — | 0.28 | 0.30 | 0.316 | 0.30 |
| | 0.495 | 0.79 | 0.93 | 1.14 | — |
| $\theta_i$ (K) | 604 | 401 | 400 | 405 | 419 |
| | | 614 | 620 | 618 | |
| $\theta_{max}$ (K) | 1677 | 1633 | 1541 | 1562 | 1520 |
| $K_1 = d_o^2/t_b$ (primary) | — | 2.71 | 1.44 | 1.04 | 1.01 |
| (overall) | 0.856 | 0.768 | 0.658 | 0.645 | — |

TABLE 2-continued

| | sample No. 1 | sample No. 2 | sample No. 3 | sample No. 4 | sample No. 5 |
|---|---|---|---|---|---|
| $K_3 = (d_o^2 - d_{th}^2)/t_o$ | 0.62 | 0.482 | 0.45 | 0.422 | 0.471 |
| $K_4 = (d_o^2 - d_{th})/t_c$ | — | 1.26 | 1.21 | 1.19 | 0.865 |

*Parameter defined in terms of overall combustion time.

I claim:

1. A mixture of molasses and a fuel oil which has been homogenized, wherein the ratio of molasses to fuel oil is within the range of from 5:95 to 95:5 by weight.

2. A homogenised mixture as claimed in claim 1, wherein the fuel oil is a petroleum-based fuel oil.

3. A homogenised mixture as claimed in claim 2, wherein the fuel oil is kerosene, diesel oil or gas oil.

4. A homogenised mixture as claimed in claim 2, wherein the fuel oil is a heavy, medium or light residual fuel oil.

5. A homogenized mixture as claimed in claim 1, wherein the ratio of molasses to fuel oil is within the range of from 85:15 to 50:50 by weight.

6. A homogenised mixture as claimed in claim 5, wherein the ratio is within the range of from 25:75 to 75:25 by weight.

7. A homogenised mixture as claimed in claim 6, wherein there is present up to 50% by weight of molasses.

8. A homogenised mixture as claimed in claim 7, wherein the ratio molasses:fuel oil is 50:50 by weight.

9. A homogenised mixture as claimed in any one of claims 1 to 8, which also comprises a homogenising agent.

10. A homogenized mixture of molasses and fuel oil wherein the ratio of molasses:fuel oil is 75:25.

11. A method of improving the burning properties of molasses, which comprises homogenizing at least 5 percent by weight of a fuel oil with the molasses.

12. An improved molasses fuel produced by the method of claim 11.

13. A homogenized mixture of molasses and a fuel oil wherein the ratio of molasses:fuel oil is 80:20.

14. A homogenized mixture of molasses and a fuel oil wherein the ratio of molasses:fuel oil is 85:15.

15. A method of generating heat, which comprises burning the homogenized mixture of claim 1 or 10.

16. A homogenized mixture of molasses and a liquid fuel oil consisting essentially of a liquid fuel oil in an amount of between about 15 and 50 percent by weight and molasses in an amount of between about 85 and 50 percent by weight, wherein the homogenized mixture shows no visual signs of separation for at least one month and has a caloric value of between about 6,470 and 11,025 BTU's per pound.

17. A method of improving the burning properties of molasses which comprises homogenizing a liquid fuel oil with the molasses to form a homogenized mixture consisting essentially of a liquid fuel oil in an amount of between about 15 and 50 percent by weight and molasses present in an amount of between about 85 and 50 percent by weight, wherein the homogenized mixture shows no visual signs of separation for at least one month and has a caloric value of between about 6,470 and 11,025 BTU's per pound.

* * * * *